US005646478A

United States Patent [19]

Nosker et al.

[11] Patent Number: 5,646,478

[45] Date of Patent: Jul. 8, 1997

[54] UNIAXIAL TENSION FOCUS MASK FOR A COLOR CRT WITH ELECTRICAL CONNECTION MEANS

[75] Inventors: Richard William Nosker, Princeton; Joey John Michalchuk, Lambertville, both of N.J.

[73] Assignee: Thomson Multimedia, S. A., Boulogne Cedex, France

[21] Appl. No.: 509,319

[22] Filed: Jul. 26, 1995

[51] Int. Cl.[6] ..... H01J 29/80

[52] U.S. Cl. ..... 313/402; 343/407; 343/408

[58] Field of Search ..... 313/402, 403, 313/407, 408, 409, 414

[56] References Cited

U.S. PATENT DOCUMENTS

| | | | |
|---|---|---|---|
| 4,059,781 | 11/1977 | Van Alpen et al. | 313/403 |
| 4,374,452 | 2/1983 | Koorneef | 445/66 |
| 4,443,499 | 4/1984 | Lipp | 427/258 |
| 4,464,601 | 8/1984 | Bloom | 313/408 X |
| 4,621,214 | 11/1986 | Bloom et al. | 313/402 |
| 4,650,435 | 3/1987 | Tamutus | 445/47 |
| 5,045,010 | 9/1991 | Fairbanks | 445/30 |
| 5,111,106 | 5/1992 | Kaplan et al. | 313/408 X |

*Primary Examiner*—Sandra L. O'Shea
*Assistant Examiner*—Mack Haynes
*Attorney, Agent, or Firm*—Joseph S. Tripoli; Dennis H. Irlbeck; Vincent J. Couglin, Jr.

[57] ABSTRACT

A color cathode-ray tube 10 has an evacuated envelope 11 with an electron gun 26 therein for generating at least one electron beam 28. The envelope further includes a faceplate panel 12 having a luminescent screen 22 with phosphor lines on an interior surface thereof. A uniaxial tension focus mask 25, having a plurality of spaced-apart first metal strands 40, is located adjacent to an effective picture area of the screen 22. The spacing between the first metal strands 40 defines a plurality of slots 42 substantially parallel to the phosphor lines of the screen. A plurality of second metal strands 60 are oriented substantially perpendicular to the first metal strands 40 and are insulated therefrom across the effective picture area by insulators 62. The second metal strands 60 are attached by a glass conductor layer 68 to respective right and left first metal end strands 140 outside the effective picture area to form busbars.

3 Claims, 3 Drawing Sheets

Fig. 2
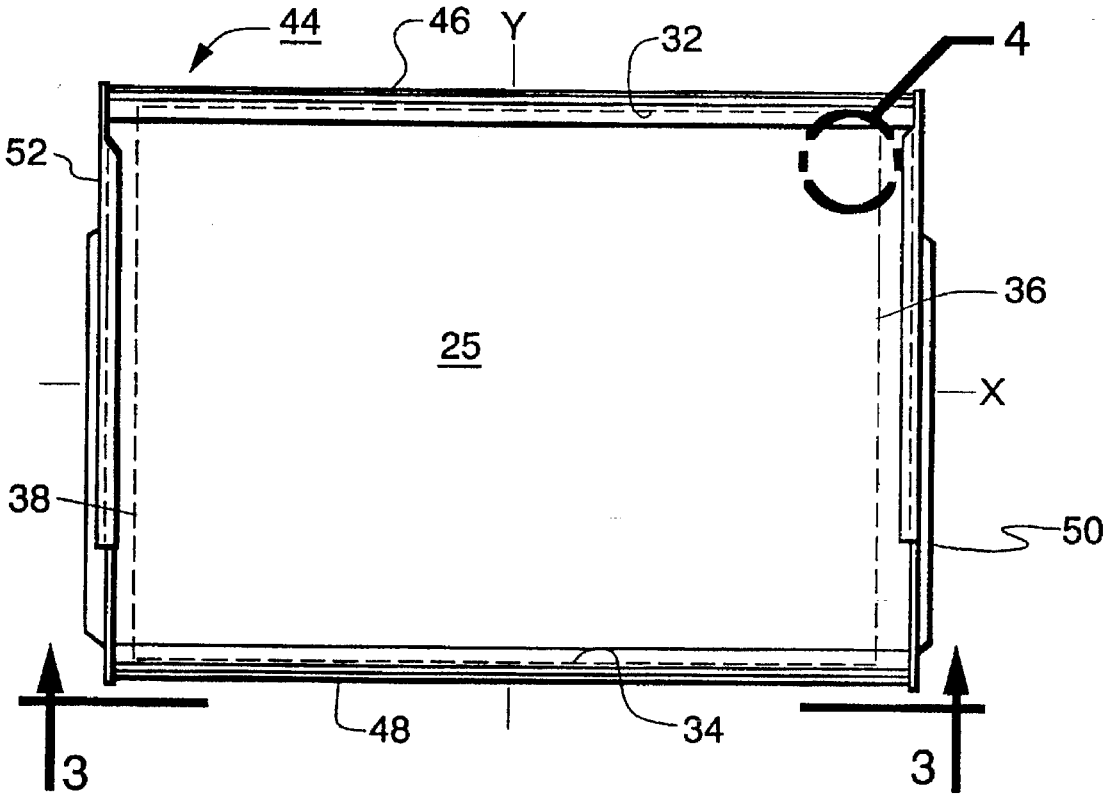
Fig. 3
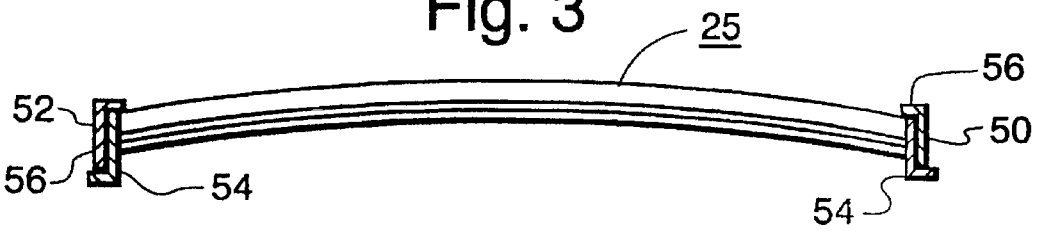
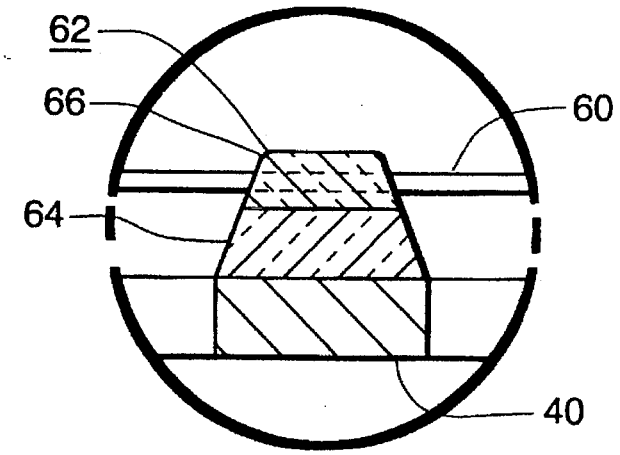
Fig. 6

UNIAXIAL TENSION FOCUS MASK FOR A COLOR CRT WITH ELECTRICAL CONNECTION MEANS

This invention relates to a color cathode-ray tube (CRT) and, more particularly, to a color CRT having a uniaxial tension focus mask having an efficient structure for making electrical connections thereto.

BACKGROUND OF THE INVENTION

A conventional shadow mask type color CRT generally comprises an evacuated envelope having therein a luminescent screen with phosphor elements of three different emissive colors arranged in color groups, in a cyclic order, means for producing three convergent electron beams directed towards the screen, and a color selection structure, such as a masking plate, between the screen and the beam-producing means. The masking plate acts as a parallax barrier that shadows the screen. The differences in the convergence angles of the incident electron beams permit the transmitted portions of the beams to excite phosphor elements of the correct emissive color. A drawback of the shadow mask type CRT is that the masking plate, at the center of the screen, intercepts all but about 18–22% of the beam current; that is, the masking plate is said to have a transmission of only about 18–22%. Thus, the area of the apertures in the plate is about 18–22% of the area of the masking plate. Since there are no focusing fields associated with the masking plate, a corresponding portion of the screen is excited by the electron beams.

In order to increase the transmission of the color selection electrode without increasing the size of the excited portions of the screen, post-deflection focusing color selection structures are required. The focusing characteristics of such structures permit larger aperture openings to be utilized to obtain greater electron beam transmission than can be obtained with the conventional shadow mask. One such structure is described in Japanese Patent Publication No. SHO 39-24981 by Sony, published on Nov. 6, 1964. In that structure, mutually orthogonal lead wires are attached at their crossing points by insulators to provide large window openings through which the electron beams pass. One drawback of such a structure is that individual electrical connections, presumably, must be made to each of the lead wires to apply suitable potentials thereto. Another color selection electrode focusing structure that partially overcomes this drawback is described in U.S. Pat. No. 4,443,499, issued on Apr. 17, 1984 to Lipp. The structure described in U.S. Pat. No. 4,443,499 utilizes a masking plate with a plurality of rectangular apertures therethrough as the first electrode. Metal ridges separate the columns of apertures. The tops of the metal ridges are provided with a suitable insulating coating. A metallized coating overlies the insulating coating to form a second electrode that provides the required electron beam focusing when suitable potentials are applied to the masking plate and to the metallized coating. Alternatively, as described in U.S. Pat. No. 4,650,435, issued on Mar. 17, 1987 to Tamutus, a metal masking plate, which forms the first electrode, is etched from one surface to provide parallel trenches in which insulating material is deposited and built up to form insulating ridges. The masking plate is further processed by means of a series of photoexposure, development, and etching steps to provide apertures between the ridges of insulating material that reside on the support plate. Metallization on the tops of the insulating ridges forms the second electrode. In the structures described in the two U.S. Patents, one of the potentials required for the operation of the color selection electrode can be applied directly to the masking plate; however, individual connections must be made to each of the second electrodes in order to apply a suitable potential thereto. Thus, a need exists for an efficient structure for making electrical connections to the second electrodes.

SUMMARY OF THE INVENTION

The present invention relates to a color cathode-ray tube having an evacuated envelope with an electron gun therein for generating at least one electron beam. The envelope further includes a faceplate panel having a luminescent screen with phosphor lines on an interior surface thereof. A uniaxial tension focus mask, having a plurality of spaced-apart first metal strands, is located adjacent to an effective picture area of the screen. The spacing between the first metal strands defines a plurality of slots substantially parallel to the phosphor lines of the screen. A plurality of second metal strands are oriented substantially perpendicular to the first metal strands and are insulated therefrom across the effective picture area. The second metal strands are attached by a glass conductor layer to respective right and left first metal end strands outside the effective picture area to form busbars.

BRIEF DESCRIPTION OF THE DRAWINGS

The invention will now be described in greater detail, with relation to the accompanying drawings, in which:

FIG. 2 is a plan view of a uniaxial tension focus mask-frame assembly used in the CRT of FIG. 1;

FIG. 3 is a front view of the mask-frame assembly taken along line 3—3 of FIG. 2;

FIG. 6 is an enlarged view of a portion of the unlaxial tension focus mask within the circle 6 of FIG. 5.

DETAILED DESCRIPTION OF THE PREFERRED EMBODIMENT

Figure 1:
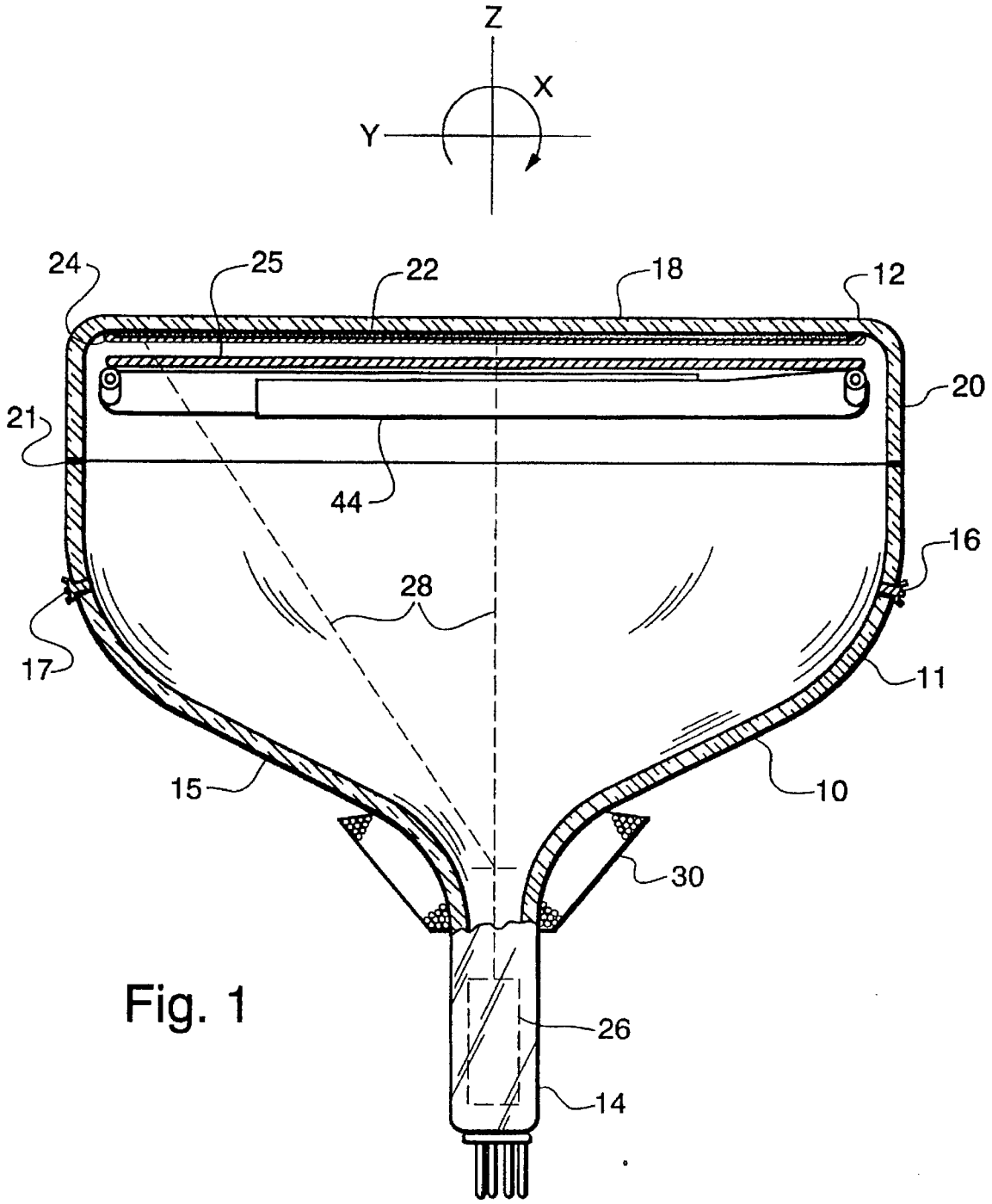
FIG. 1 is a plan view, partly in axial section, of a color CRT embodying the invention.

FIG. 1 shows a color CRT 10 having a glass envelope 11 comprising a rectangular faceplate panel 12 and a tubular neck 14 connected by a rectangular funnel 15. The funnel has an internal conductive coating (not shown) that is in contact with, and extends from, a first anode button 16 to the neck 14. A second anode button 17, located opposite the first anode button 16, is not contacted by the conductive coating. The panel 12 comprises a cylindrical viewing faceplate 18 and a peripheral flange or sidewall 20 that is sealed to the funnel 15 by a glass frit 21. A three-color luminescent phosphor screen 22 is carded by the inner surface of the faceplate 18. The screen 22 is a line screen, shown in detail in FIG. 5, that includes a multiplicity of screen elements comprised of red-emitting, green-emitting, and blue-emitting phosphor lines, R, G, and B, respectively, arranged in triads, each triad including a phosphor line of each of the three colors. Preferably, a light absorbing matrix 23 separates the phosphor lines. A thin conductive layer 24, preferably of aluminum, overlies the screen 22 and provides means for applying a uniform first anode potential to the screen as well as for reflecting light, emitted from the phosphor elements, through the faceplate 18. A cylindrical multi-apertured color selection electrode, or uniaxial tension focus mask, 25 is removably mounted, by conventional means, within the panel 12, in predetermined spaced relation to the screen 22. An electron gun 26, shown schematically by the dashed lines in FIG. 1, is centrally mounted within the neck 14 to generate and direct three inline electron beams 28, a center and two side or outer beams, along convergent paths through the mask 25 to the screen 22. The inline direction of the beams 28 is normal to the plane of the paper.

Figure 4:
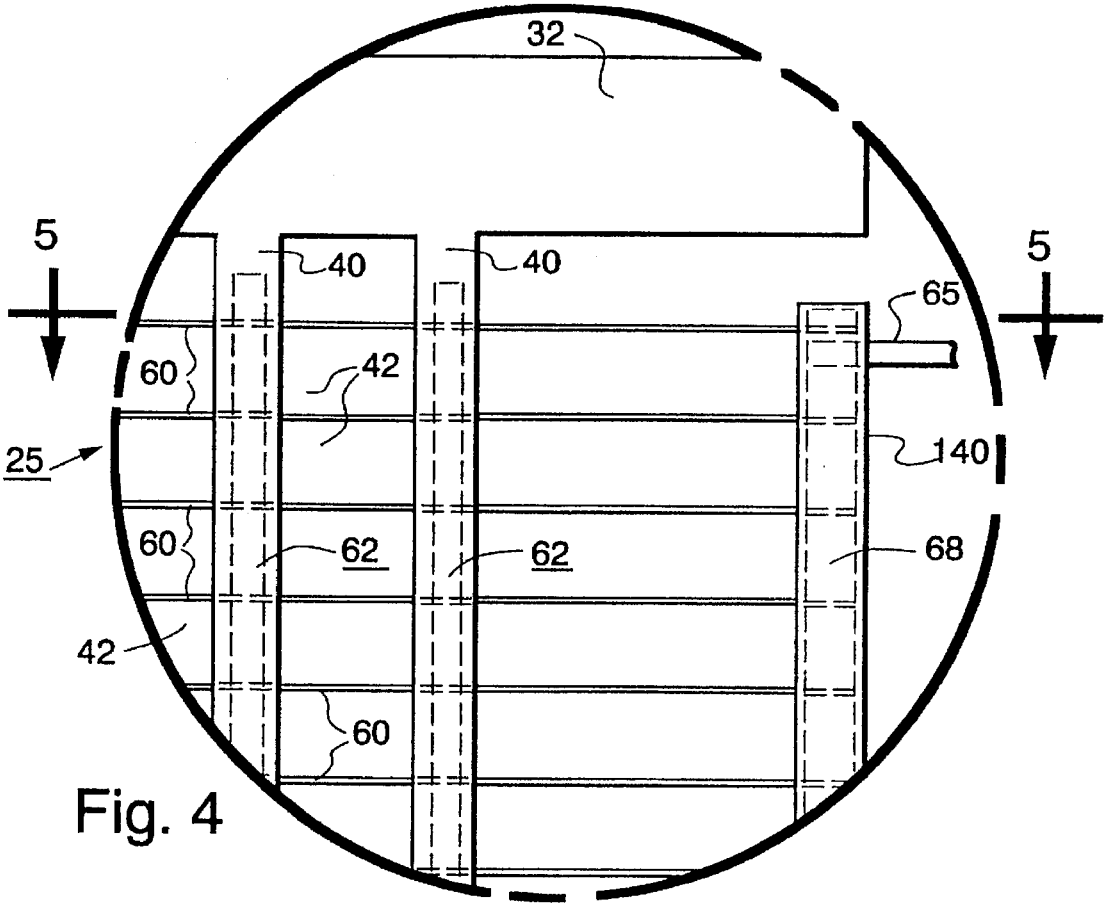
FIG. 4 is an enlarged section of the uniaxial tension focus mask shown within the circle 4 of FIG. 2.

The CRT of FIG. 1 is designed to be used with an external magnetic deflection yoke, such as the yoke 30, shown in the neighborhood of the funnel-to-neck junction. When activated, the yoke 30 subjects the three beams to magnetic fields that cause the beams to scan a horizontal and vertical rectangular raster over the screen 22. The uniaxial tension mask 25 is formed, preferably, from a thin rectangular sheet of about 0.05 mm (2 mil) thick low carbon steel, that is shown in FIG. 2 and includes two long sides 32, 34 and two short sides 36, 38. The two long sides 32, 34 of the mask parallel the central major axis, X, of the CRT and the two short sides 36, 38 parallel the central minor axis, Y, of the CRT. The steel has a composition, by weight, of about 0.005% carbon, 0.01% silicon, 0.12% phosphorus, 0.43% manganese, and 0.007% sulfur. Preferably, the ASTM grain size of the mask material is within the range of 9 to 10. The mask 25 includes an apertured portion that is adjacent to and overlies an effective picture area of the screen 22 which lies within the central dashed lines of FIG. 2 that define the perimeter of the mask 25. As shown in FIG. 4, the uniaxial tension focus mask 25 includes a plurality of elongated first metal strands 40, each having a transverse dimension, or width, of about 0.3 mm (12 mils) separated by substantially equally spaced slots 42, each having a width of about 0.55 mm (21.5 mils) that parallel the minor axis, Y, of the CRT and the phosphor lines of the screen 22. In a color CRT having a diagonal dimension of 68 cm (27 V), there are about 600 of the first metal strands 40. Each of the slots 42 extends from the long side 32 of the mask to the other long side 34, not shown in FIG. 4. A frame 44, for the mask 25, is shown in FIGS. 1–3 and includes four major members, two torsion tubes or curved members 46 and 48 and two tension arms or straight members 50 and 52. The two curved members, 46 and 48, parallel the major axis, X, and each other. As shown in FIG. 3, each of the straight members 50 and. 52 includes two overlapped partial members or parts 54 and 56, each part having an L-shaped cross-section. The overlapped parts 54 and 56 are welded together where they are overlapped. An end of each of the parts 54 and 56 is attached to an end of one of the curved members 46 and 48. The curvature of the curved members 46 and 48 matches the cylindrical curvature of the uniaxial tension focus mask 25. The long sides 32, 34 of the uniaxial tension focus mask 25 are welded between the two curved members 46 and 48 which provide the necessary tension to the mask. Before welding to the frame 44, the mask material is pre-stressed and darkened by tensioning the mask material while heating it, in a controlled atmosphere of nitrogen and oxygen, at a temperature of about 500° C. for one hour. The frame 44 and the mask material, when welded together, comprise a uniaxial tension mask assembly.

Figure 5:
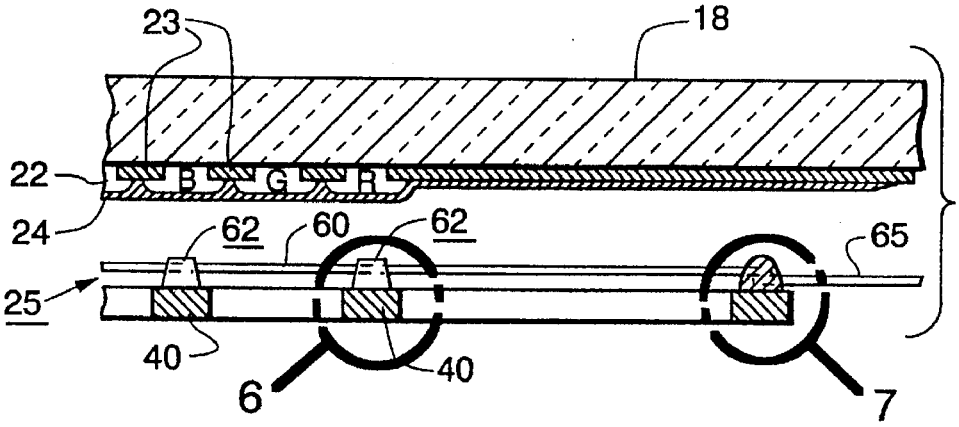
FIG. 5 is a section of the unlaxial tension focus mask and the luminescent screen taken along lines 5—5 of FIG. 4.

With reference to FIGS. 4 and 5, a plurality of second metal strands 60, each having a diameter of about 0.025 mm (1 mil), are disposed substantially perpendicular to the first metal strands 40 and are spaced therefrom by an insulator 62 formed on the screen-facing side of each of the first metal strands. The second metal strands 60 form cross members that facilitate applying a second anode, or focusing, potential to the mask 25. The preferred material for the second metal strands is HyMu80 wire, available from Carpenter Technology, Reading, Pa. The vertical spacing, or pitch, between adjacent second strands 60 is about 0.41 mm (16 mils). Unlike the cross members described in the prior art that have a substantial dimension that significantly reduces the electron beam transmission of the masking plate, the relatively thin second metal strands 60 provide the essential focusing function to the present uniaxial focus tension mask 25 without adversely affecting the electron beam transmission thereof. The uniaxial tension focus mask 25, described herein, provides a mask transmission, at the center of the screen, of about 60%, and requires that the second anode, or focusing, voltage, $\Delta V$, applied to second strands 60, differs from the first anode voltage applied to the first metal strands 40 by less than about 1 kV, for a first anode voltage of about 30 kV.

The insulators 62, shown in FIGS. 4 and 5, are disposed substantially continuously on the screen-facing side of each of the first metal strands 40. The second metal strands 60 are bonded to the insulators 62 to electrically isolate the second metal strands 60 from the first metal strands 40.

The method of making the uniaxial tension focus mask 25 includes providing, e.g., by spraying, a first coating of an insulative, devitrifying solder glass onto the screen-facing side of the first metal strands 40. A suitable solvent and an acrylic binder are mixed with the devitrifying solder glass to give the first coating a modest degree of mechanical strength. The first coating has a thickness of about 0.14 mm. The frame 44, to which the first metal strands 40 are attached, is placed into an oven and the first coating is dried at a temperature of about 80° C. A devitrifying solder glass is one that melts at a specific temperature to form a crystallized glass insulator. The resultant crystallized glass insulator is stable and will not remelt when reheated to the same temperature. After drying, the first coating is contoured so that it is shielded by the first metal strands 40 to prevent the electron beams 28, passing thought the slots 42, from impinging upon the insulator and charging it. The contouring is performed on the first coating by abrading or otherwise removing any of the solder glass material of the first coating that extends beyond the edge of the strands 40 and would be contacted by either the deflected or undeflected electron beams 28. The first coating is entirely removed, by modest mechanical action, from the initial and ultimate, i.e., the right and left first metal strands, hereinafter designated the first metal end strands 140, before the first coating is heated to the sealing temperature. The first metal end strands 140, which are outside of the effective picture area, subsequently will be used as busbars to address the second metal strands 60. To further ensure the electrical integrity of the uniaxial tension focus mask 25 by minimizing the possiblity of a short circuit, at least one additional first metal strand 40 is removed between the first metal end strands 140 and the first metal strands 40 that overlie the effective picture area of the screen. Thus, the right and left first metal end strands 140, outside the effective picture area, are spaced from the first metal strands 40 that overlie the picture area by a distance of at least 1.4 mm (55 mils), which is greater than the width of the equally spaced slots 42 that separate the first metal strands 40 across the picture area.

The frame 44 with the first metal strands 40 and the metal end strands 140 attached thereto (hereinafter referred to as the assembly) is placed into an oven and heated in air. The assembly is heated over a period of 30 minutes to a temperature of 300° C. and held at 306° C. for 20 minutes. Then, over a period of 20 minutes, the temperature of the oven is increased to 460° C. and held at that temperature for one hour to melt, and crystallize the first coating to form a first insulator layer 64 on the first metal strands 40, as shown in FIG. 6. The resultant first insulator layer 64, after firing, has a thickness within the range of 0.5 to 0.9 mm (2 to 3.5 mils) across each of the strands 40. The preferred solder glass for the first coating is a lead-zinc-borosilicate solder glass that melts in the range of 400° to 450° C. and is commercially available, as SCC-11, from a number of glass suppliers, including SEM-COM, Toledo, Ohio, and Coming Glass, Coming, N.Y.

Next, a second coating of a suitable insulative material, mixed with a solvent, is applied, e.g., by spraying, to the first insulator layer 64. Preferably, the second coating is a non-devitrifying (i.e., vitreous) solder glass having a composition of 80 wt. % PbO, 5 wt % ZnO, 14 wt. % $B_2O_3$, 0.75 wt. % $SnO_2$, and, optionally, 0.25 wt. % CoO. A vitreous material is preferred for the second coating because when it melts, it will fill any voids in the surface of the first insulator layer 64 without adversely affecting the electrical and mechanical characteristics of the first layer. Alternatively, a devitrifying solder glass may be used to form the second coating. The second coating is applied to a thickness of about 0.025 to 0.05 mm (1 to 2 mils). The second coating is dried at a temperature of 80° C. and contoured, as previously described, to remove any excess material that could be struck by the electron beams 28.

Figure 7:
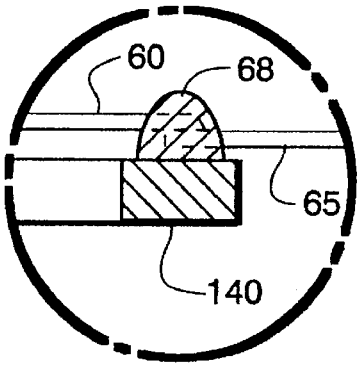
FIG. 7 is an enlarged view of another portion of the uniaxial tension focus mask within the circle 7 of FIG. 5.

As shown in FIGS. 4, 5 and 7, a thick coating of a devitrifying solder glass containing silver, to render it conductive, is provided on the screen-facing side of the left and right first metal end strands 140. A conductive lead 65, formed from a short length of nickel wire, is embedded into the conductive solder glass on one of the first metal end strands. Then, the assembly, having the dried and contoured second coating overlying the first insulator layer 64, has the second metal strands 60 applied thereto so that the second metal strands overlie the second coating of insulative material and are substantially perpendicular to the first metal strands 40. The second metal strands 60 are applied using a winding fixture, not shown, that accurately maintains the desired spacing of about 0.41 mm between the adjacent second metal strands. The second metal strands 60 also contact the conductive solder glass on the first metal end strands 140. Alternatively, the conductive solder glass can be applied at the junction between the second metal strands 60 and the first metal end strands 140 during, or after, the winding operation. Next, the assembly, including the winding fixture, is heated for 7 hours to a temperature of 460° C. to melt the second coating of insulative material, as well as the conductive solder glass, to bond the second metal strands 60 within both a second insulator layer 66 and to a glass conductor layer 68. The second insulator layer 66 has a thickness, after sealing, of about 0.013 to 0.025 mm (0.5 to 1 mil). The height of the glass conductor layer 68 is not critical, but should be sufficiently thick to firmly anchor the second metal strands 60 and the conductive lead 65 therein. The portions of the second metal strands 60 extending beyond the glass conductor layer 68 are trimmed to free the assembly from the winding fixture.

The first metal end strands 140 are severed at the ends adjacent to long side or top portion 32, shown in FIG. 4, and long side or bottom portion 34 (not shown) of the mask 25 to provide a gaps of about 0.4 mm (15 mils) therebetween that electrically isolate the first metal end strands 140 and forms busbars that permit a second anode voltage to be applied to the second metal strands 60 when the conductive lead 65, embedded in the glass conductor layer 68, is connected to the second anode button 17.

What is claimed is:

1. In a color cathode-ray tube comprising an evacuated envelope having therein an electron gun for generating at least one electron beam, a faceplate panel having a luminescent screen with phosphor lines on an interior surface thereof, and a uniaxial tension focus mask, wherein the improvement comprising said uniaxial tension focus mask having a plurality of spaced-apart first metal strands which are adjacent to an effective picture area of said screen and define a plurality of slots substantially parallel to said phosphor lines, said first metal strands being formed from a thin metal sheet having imperforate top and bottom portions, said right and left first metal end strands each having top and bottom ends separated from said top and bottom portions of said metal sheet by gaps to electrically isolate said right and left first metal end strands; and a plurality of second metal strands oriented substantially perpendicular to said first metal strands and insulated therefrom across said effective picture area, said second metal strands being attached by a glass conductor layer to said right and left first metal end strands outside of said effective picture area to form busbars.

2. The tube as described in claim 1, further including a conductive lead embedded in said glass conductor layer of one of said first metal end strands outside said effective picture area.

3. The tube as described in claim 1, wherein said right and left first metal end strands outside said effective picture area are spaced from first metal strands across said effective picture area by a distance greater than the spacing of said slots across said effective picture area.

* * * * *